US008317558B2

(12) United States Patent
Bucknell et al.

(10) Patent No.: US 8,317,558 B2
(45) Date of Patent: Nov. 27, 2012

(54) COMPOUND ROTATIONAL GRIP

(76) Inventors: Scott Bucknell, Haleiwa, HI (US); David Bucknell, Orlando, FL (US); Fred Lane, Mosinee, WI (US)

( * ) Notice: Subject to any disclaimer, the term of this patent is extended or adjusted under 35 U.S.C. 154(b) by 158 days.

(21) Appl. No.: 12/623,331

(22) Filed: Nov. 20, 2009

(65) Prior Publication Data

US 2010/0124859 A1 May 20, 2010

Related U.S. Application Data

(60) Provisional application No. 61/116,552, filed on Nov. 20, 2008.

(51) Int. Cl.
*B63H 16/04* (2006.01)

(52) U.S. Cl. ..... 440/101; 416/74

(58) Field of Classification Search ..... 440/101, 440/102, 103; 416/70 R, 72, 74
See application file for complete search history.

(56) References Cited

U.S. PATENT DOCUMENTS

| | | | | | |
|---|---|---|---|---|---|
| 2,913,727 | A * | 11/1959 | Smith | ..... | 416/72 |
| 3,092,855 | A * | 6/1963 | Smith | ..... | 416/72 |
| 4,701,142 | A * | 10/1987 | Merritt | ..... | 440/101 |
| 5,265,307 | A * | 11/1993 | Hull et al. | ..... | 16/406 |
| 2005/0153606 | A1 * | 7/2005 | Lane et al. | ..... | 440/101 |

* cited by examiner

*Primary Examiner* — Lars A Olson
(74) *Attorney, Agent, or Firm* — Lane Patents LLC

(57) ABSTRACT

An improved paddle apparatus for standup paddling of surfboards or like water craft, having a plurality of hand grip portions rotatably mounted relative to the paddle shaft, and a means of paddling whereby the operator can ergonomically paddle with greater power and control on either side of the water craft without breaking either hand grip. A further improvement includes using the handgrip in the position perpendicular to the paddle shaft to determine the blade position by feel and steer with greater torque. An alternative embodiment includes rotation of the grip itself, further reducing the twisting of the wrists and other joints.

10 Claims, 3 Drawing Sheets

COMPOUND ROTATIONAL GRIP

BACKGROUND OF THE INVENTION

1. Field of the Invention

The present invention relates generally to an ergonomic grip for human powered propulsion through water using paddles or oars, particularly the sport of standup surfing, which requires the paddler to exercise extreme angles for blade entry. More specifically the present invention relates to an improved handle system of rotating a grip having compound axis of rotation. Such a system allows a paddler to paddle on either side of a surfboard while standing with correct form for maximum power without breaking the hand grip yet exercising good ergonomic form.

2. Description of the Related Art

Surfing has been a popular sport on the Hawaiian Islands for generations. Typically the surfer lays on his or her stomach to paddle, when not under wave power. Recently surfboards have been used with a paddler standing in relatively small waves, such as a bay with paddles for propelling the floating craft through water. Typically the paddles are double bladed.

It is advantageous for the blade of the paddle to enter the water directly next to the watercraft. From this more natural position the power of the stroke is greatly increased while reducing the angular torque, which tends to send the watercraft off course.

In addition, the paddler wants to minimize twisting of the torso. This unnatural twisting not only reduces efficiency, but also leads to fatigue. Over extended periods of time it can lead to repetitive strain injury to the wrists, arms, and torso.

Injuries common to prolonged double bladed paddle use include; carpal tunnel syndrome, wrist tendonitis, rotator cuff muscle tears and back strains and injuries.

One reference in the prior art is application Ser. No. 10/905,576 to Lane et al. showing a paddle attachment having a rotating grip. The present invention provides another axis of rotation to provide further relief to joints. Further, springs have been added to provide a "home position" when at the top of stroke, when the grip is horizontal.

The constant need to change and adjust the grips demonstrated in the prior art have hindered the use of a breakaway adhesive to better adhere the users hand to the paddle.

DESCRIPTION OF THIS INVENTION (ART)

Summary

The principle object of this invention is to provide an improved paddle device for standup paddling for surfboards or like water craft, having a plurality of handgrip portions rotatably mounted relative to the paddle shaft having advantage of compound rotation.

OBJECTS AND ADVANTAGES

Another objective of the invention is to introduce a rotatable handgrip with stops to lock the grips in position roughly parallel to the shaft and perpendicular to the shaft.

Another objective is to provide the advantages of a single bladed "t" handle grip without the disadvantage of interference to the grip by the shaft.

It is a further objective to introduce a method of paddling incorporating advantages of both single and double bladed paddles by means of a dynamically rotating grip portion of the paddle.

In this method the operator can ergonomically paddle or maneuver using a double bladed paddle with the same motion as a "T" gripped single bladed paddle to propel the craft with greater power and accuracy than with the double bladed paddle.

The operator can use this double bladed handle can be used on either side of the watercraft without breaking their hand grip by dynamically rotating the grip from one position to another.

Further this method of paddling allows more free and natural movement of the arms and torso reducing stress to the joints and muscle groups.

In addition this method of paddling allows complex maneuvers on either side of the craft quickly without breaking the hand's grip. By rotating either grip to the orthogonal position the grip becomes a lever for the paddler to know the position of the blade, which is also in the same plain as the races, and to be able to exert more force to steering or other maneuvers.

Another advantage, because the handgrip need not be broken to execute complex maneuvers, or switching sides, aids to improve the grip such as Velcro, or other chemical sticking agents, on gloves, can now be used to reduce fatigue by securing the hand to the paddle grip.

An alternative embodiment includes rotation of the grip itself allowing complex rotation and further reducing the twisting of the wrists and other joints.

A further embodiment of this invention includes a hollow diameter of shaft tubing, for improving the strength to weight ratio, larger than can easily be gripped by a person. This is because the handgrip and the shaft are no longer the same piece.

A further embodiment of the present invention includes multiple parallel shafts between the grips and/or between the grip and the paddle acting as a beam to further strengthen and stiffen the resulting structure.

With the embodiment of the parallel shafts, the grip portion may be moved up and down the beam to accommodate the needs of the paddler.

A further embodiment of this invention includes a further protection of the knuckles of the hand by a hand guard.

A further embodiment of this invention includes the use of ball bearings in the rotatable portion of the handle to make the dynamic rotation movement smoother.

A further embodiment of this invention allows a soft locking mechanism to lock the grip into position.

A further embodiment of this invention allows an opening near the stop as a pressure release, which has several advantages: first it soft locks the paddle into the stop position; second this acts as a mechanism to remove sand or grit the would otherwise be trapped in the races.

The foregoing has outlined rather broadly the features and technical advantages of this invention so that those skilled in the art may better understand the detailed description that follows.

Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

DRAWING FIGURES

DESCRIPTION

Figs Preferred Embodiment

Figure 1:
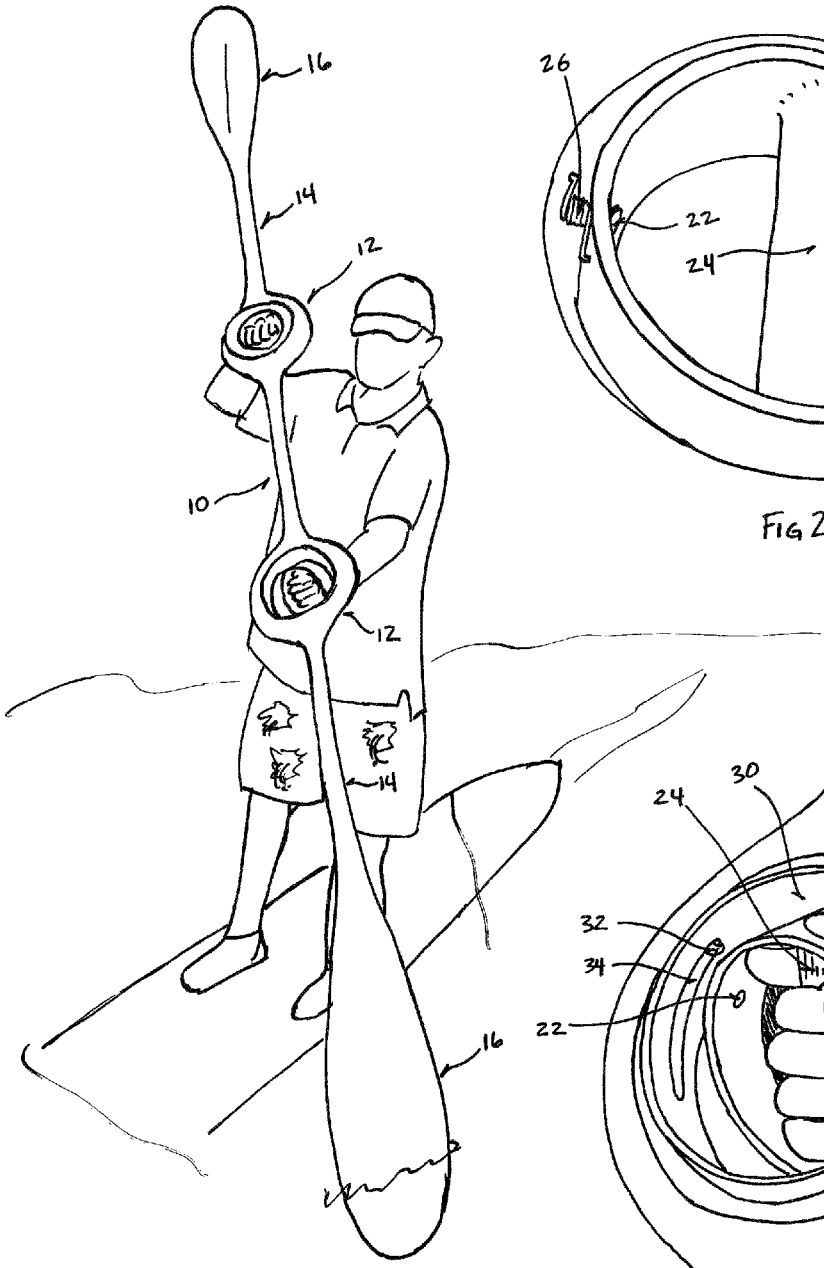
FIG. 1 shows an illustrative perspective view of a person paddling with one embodiment of the present invention.
Figure 2:
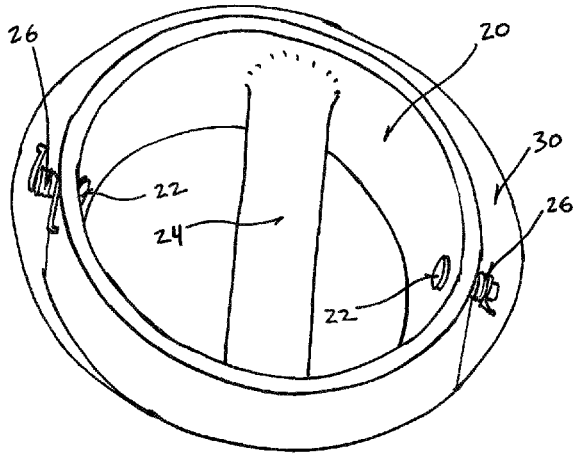
FIG. 2 shows a top perspective view of one embodiment of the present invention.
Figure 3:
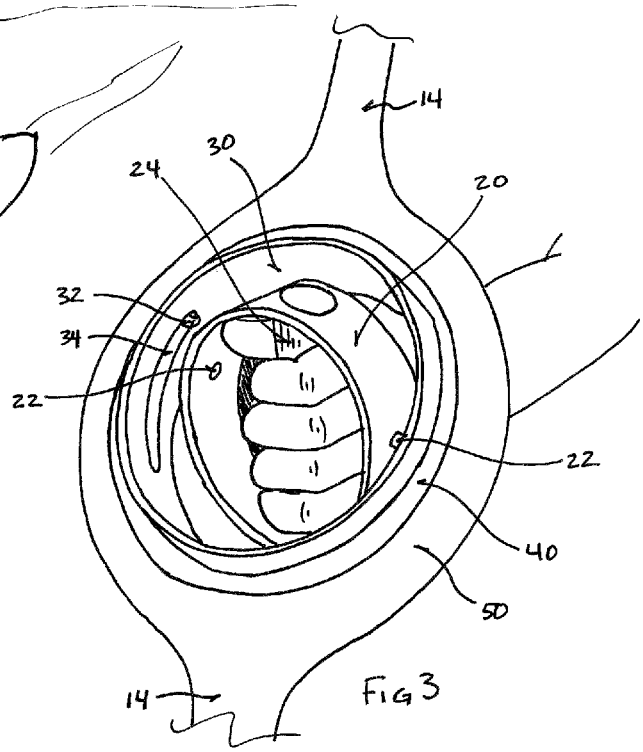
FIG. 3 shows a detail perspective view of an alternate embodiment of the present invention.
Figure 4:
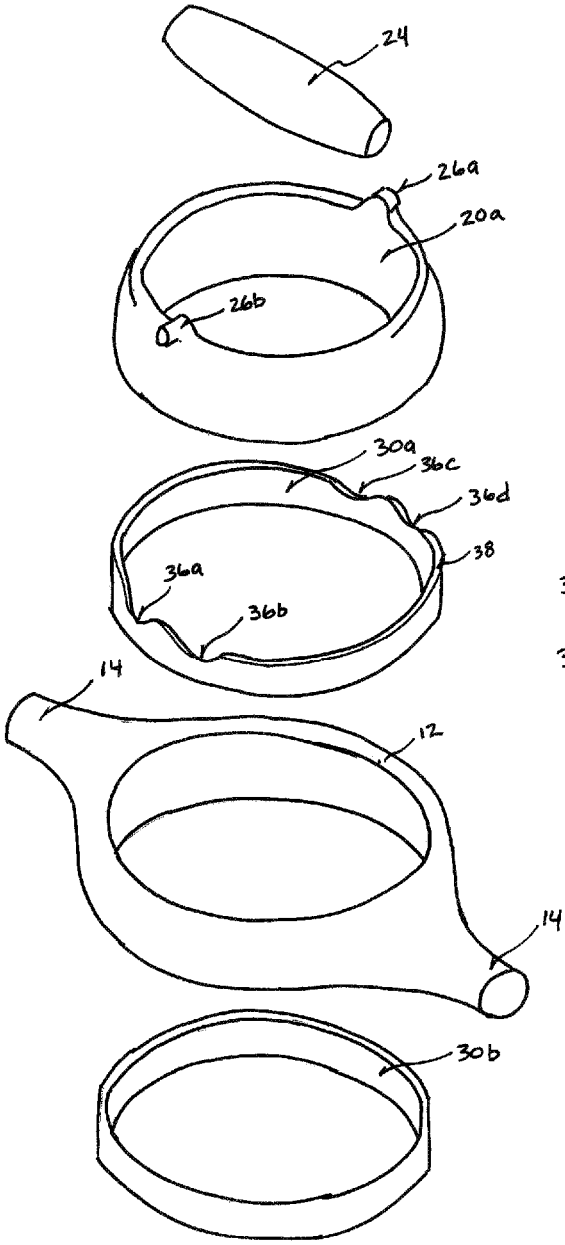
FIG. 4 shows an exploded view of a preferred embodiment of the present invention.
Figure 5:
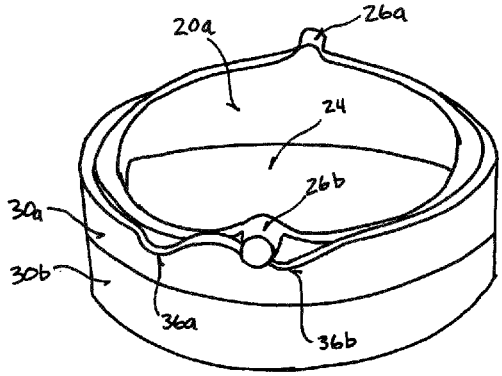
FIG. 5 shows an anterior perspective view of a portion of the embodiment from FIG. 4.
Figure 6:
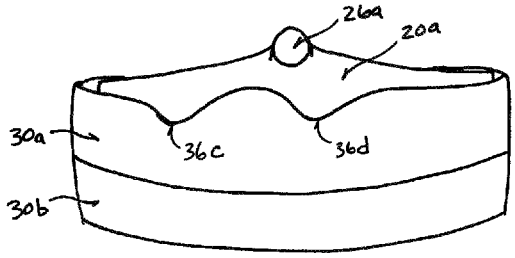
FIG. 6 shows a posterior perspective view of a portion of the embodiment from FIG. 4.
Figure 7:
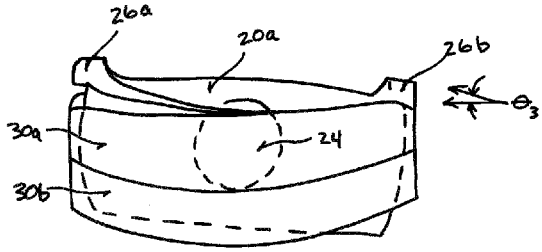
FIG. 7 shows a lateral perspective view of the embodiment from FIGS. 5 and 6.

FIGS. 1, 2 and 3 illustrate several advantages of the present invention. When standing while padding, the paddler's torso is positioned well above the water level requiring a steep level of entry of the paddle blade (16) and shaft (14). The outer housing (12) is positioned generally in the same plane as the blade orientation (16) but can be offset, for example in an orientation known in the art as feathering. The paddler's top grip is rotated to be approximately 90° out of phase with the shaft (14) while the bottom grip is generally in phase with the shaft (14), while creating a compound angle as shown in FIG. 3 an azimuth with the plane of the paddle (16) blade. Azimuth can generally be defined as an angle being formed by a non orthogonal projection from the plane of the ring. In the present embodiment, an interior annular structure (20) being in connection with a grip (24), and sized and formed to conform with the human hand, about 12 to 14 cm inner diameter. The grip (24) has a diameter to be gripped comfortably about 2.5 to 3 cm, with a length to fit inside the interior annular structure (20). The first interior annular structure (20) is attached to rotate about a connector (22) in such a way as to form compound angles between the interior annular structure (20) and a second medial annular structure (30) which is generally constrained to be positioned in the plane defined by the paddle blade, yet is able to rotate within that plane. This particular embodiment further comprises a pin and a race to constrain the rotation in a predetermined fashion. Further, a return mechanisms (26), in this case springs, but can also be stops, elastic members and the like, can be used to modulate travel of the wrist in a predetermined and ergonomic fashion.

Figure 8:
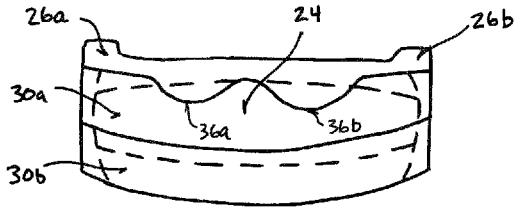
FIG. 8 shows a lateral perspective view of the embodiment from FIG. 7 with the inner annular structure and grip rotated 90 degrees.

FIGS. 4, 5, 6, 7, 8 show an alternate and generally preferred embodiment for the housing (12). An alternate interior annular structure (20*a*), having a slightly convex outer cylinder, is fitted between a superior medial annular structure (30*a*) and an inferior medial annular structure (30*b*) having in inner cylinder being substantially matched to the outer cylinder of the interior annular structure, so as to generally make a ball and socket type fitting. The medial annuli (30*a, b*) being secured to the outer housing (12). In such an arrangement, and without further constraints, the interior annular structure (20*a*) would be free to rotate in any direction. A plurality of stop pins (26*a, b*); preferably two, however, more can be accommodated, are placed to constrain the movement of the interior annular structure (20*a*) in a rotation generally concentric with the support (38) edge of the superior medial annular structure (30*a*) in a smooth fashion. The support (38) edge substantially laying parallel to a plane orthogonal to the vector of rotation of the annular structure. As a stop pin (26*a* or *b*) rotates into the vicinity of a soft swivel guide (36*a, b, c*, or *d*), which are located in predetermined positions around the support (38) a pin (36*a, b, c*, or *d*) is free to rotate azimuthally creating compound rotation as indicated by theta 3 in FIG. 7. FIG. 8 shows a situation where a pair of stop pins (26*a* and *b*) are situated between two soft swivel guides (36*a, b*) thus removing opportunity for azimuthal movement.

Figure 9A:
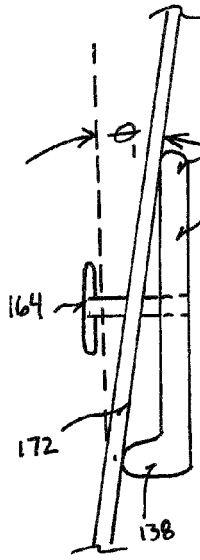
FIG. 9A shows a schematic side view (B) of a base member being attached to a d frame in a partially rotated position creating an angle theta 1.
Figure 9B:
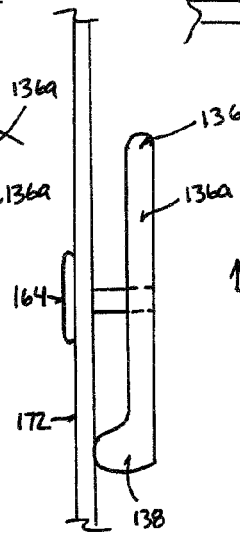
FIG. 9B shows a schematic side view (B) of a base member being attached to a d frame wherein theta is zero.
Figure 9C:
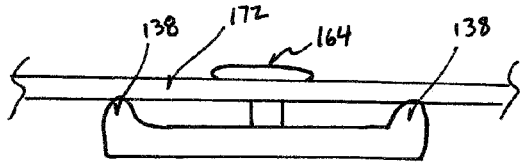
FIG. 9C shows a schematic side view (A) of a base member being attached to a d frame which has been rotated 90 degrees showing the d frame being laterally constrained.
Figure 9D:
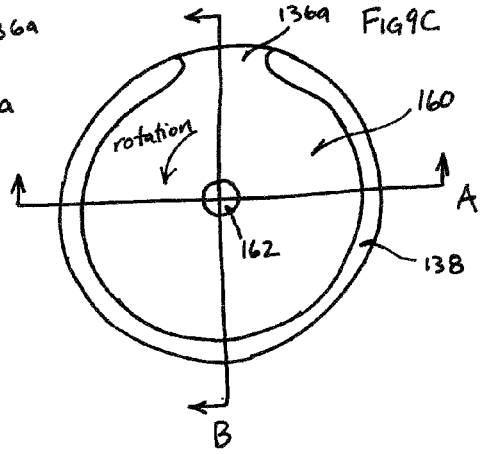
FIG. 9D shows a top down view of a base member
Figure 10A:
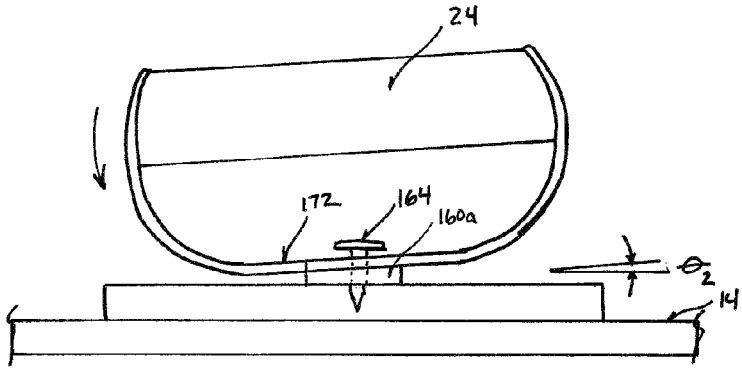
FIG. 10A shows a side view of a grip mounted on a d frame with in a partially rotated configuration.
Figure 10B:
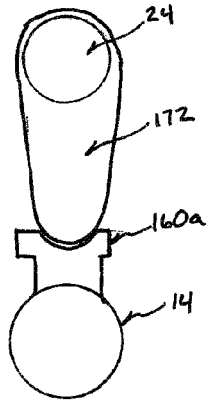
FIG. 10B shows a face on view of the configuration in FIG. 10A.
Figure 11:
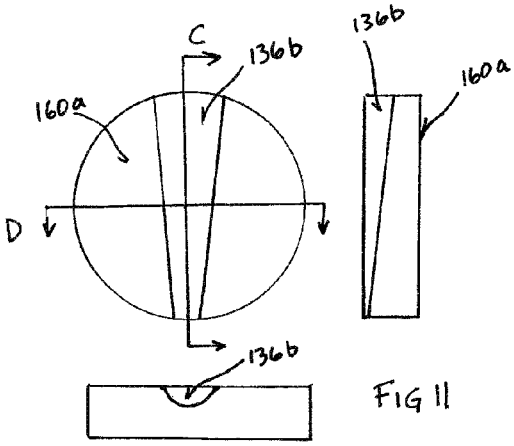
FIG. 11 shows an alternate embodiment to the configuration shown in FIG. 9.

FIGS. 9 through 11 shows yet a further embodiment comprising compound rotation. FIG. 10A shows a grip (24) being attached to a d frame (172) structure; which can be plastic, aluminum, or other sturdy material, and being attached to a base member (160) by means of a locking pin (164), the locking pin comprising a secure connection about which the d frame (172) being able to rotate or twist about the locking pin (164). The base member (160) can be removably attached to a shaft (14), as is known in the art.

As shown in FIG. 10B, it is preferred the d frame (172) be rounded, chamfered, terrace, stepped, sloped or the like, in order to better interface with an alternate soft swivel guide (136*a*, or *b*) to allow rotation in as smooth a manner possible. One or more soft swivel guides (136*a* or *b*) can be located in a base member (160 or 160*a*). As the orientation of the d frame (172) is oriented in accordance with the support (138) in FIG. 9 or the planar surface in FIG. 11, the d frame (160) and therefore the grip (24) will have no bases for azimuthal orientation. As, however, the d frame (160) becomes oriented or aligned with a soft swivel guide (136, 136*a*) which is generally formed as a depression, corrugation, trough, channel, trench, furrow or the like; relative to the plane of the base member (160) an azimuthal angle, such as theta 1 shown in FIG. 9A is formed. One skilled in the art can determine the optimal azimuth for a given situation and further adjust the support (138) height or equivalent to achieve the desired result.

CONCLUSION, RAMIFICATIONS, AND SCOPE

Although the present invention has been described in detail, those skilled in the art will understand that various changes, substitutions, kiralgnev and alterations herein may be made without departing from the spirit and scope of the invention in its broadest form.

What is claimed is:

1. An ergonomic handle system for human propulsion through water using paddles or oars having at least one paddle blade and an outer housing positioned substantially in the same plane as the paddle blade orientation; the handle system further comprising an interior annular structure being in connection with a grip; the interior annular structure having a compound axis of rotation relative to the plane of the paddle blade.

2. An ergonomic handle system for human propulsion through water using paddles or oars in accordance with claim 1 further comprising a medial annular structure which rotates in the plane defined by the outer housing and a connector attached between medial annular structure and a first interior annular structure into rotate about the connector to form the compound axis of rotation.

3. An ergonomic handle system for human propulsion through water using paddles or oars in accordance with claim 1 having a slightly convex outer cylinder and having an inner cylinder being substantially matched to the outer cylinder so as to make a ball and socket type fitting.

4. An ergonomic handle system for human propulsion through water using paddles or oars in accordance with claim 3 further comprising a plurality of stop pins to constrain the movement of the interior annular structure.

5. An ergonomic handle system for human propulsion through water using paddles or oars in accordance with claim 4 further comprising at least one swivel guide.

6. An ergonomic handle system for human propulsion through water using paddles or oars in accordance with claim 1 further comprising a d frame structure attached to a base member.

7. An ergonomic handle system for human propulsion through water using paddles or oars in accordance with claim 6 wherein the base member is removably attached to a shaft.

8. An ergonomic handle system for human propulsion through water using paddles or oars in accordance with claim 7 further comprising one or more swivel guides located on the base member.

9. An ergonomic handle system for human propulsion through water using paddles or oars having at least one paddle blade and an outer housing in substantially the same plane as the paddle blade orientation and comprising a compound axis of rotation of a grip relative to a plane defined by a surface of the paddle blade further comprising a spring return mechanism.

10. An ergonomic handle system for human propulsion through water using paddles or oars in accordance with claim 9 further comprising a stop to modulate a wrist in a predetermined and ergonomic fashion.

* * * * *